US010823523B1

(12) United States Patent
Wynes

(10) Patent No.: US 10,823,523 B1
(45) Date of Patent: Nov. 3, 2020

(54) TEMPERATURE COMPENSATOR FOR ARTILLERY SYSTEM

(71) Applicant: MANDUS GROUP LLC, Rock Island, IL (US)

(72) Inventor: Kenneth Wynes, Milan, IL (US)

(73) Assignee: MANDUS GROUP LLC, Rock Island, IL (US)

( * ) Notice: Subject to any disclaimer, the term of this patent is extended or adjusted under 35 U.S.C. 154(b) by 0 days.

(21) Appl. No.: 16/582,863

(22) Filed: Sep. 25, 2019

(51) Int. Cl.
*F41A 25/04* (2006.01)

(52) U.S. Cl.
CPC ..... *F41A 25/04* (2013.01)

(58) Field of Classification Search
CPC ..... F41A 25/04; F41A 25/02
See application file for complete search history.

(56) References Cited

U.S. PATENT DOCUMENTS 1,575,845 A * 3/1926 Joyce ..... F16F 9/43 89/43.01
3,410,174 A * 11/1968 Hahn ..... F16F 9/44 89/43.01
4,867,038 A * 9/1989 Metz ..... F41A 25/02 89/43.01
4,875,402 A * 10/1989 Metz ..... F41A 25/02 89/43.01
4,957,033 A * 9/1990 Relange ..... F41A 25/02 89/43.01
6,227,097 B1 * 5/2001 Brianne ..... F41A 25/02 89/198
6,694,856 B1 * 2/2004 Chen ..... F16F 9/535 89/43.01
7,938,054 B2 * 5/2011 Trigo ..... F41A 25/04 89/129.01
2004/0154465 A1 * 8/2004 Martin ..... F41A 25/02 89/42.01

* cited by examiner

*Primary Examiner* — Michelle Clement
(74) *Attorney, Agent, or Firm* — Dorsey & Whitney LLP

(57) ABSTRACT

A temperature compensator for a recoil system and methods of use therein are disclosed. The temperature compensator can be used to regulate compressible fluid flow in a recoil system for an artillery weapon, including limiting a total volume of compressible fluid used to drive recoiling components of the system. This allows the recoil parts be to driven with consistency, notwithstanding the volumetric expansion of the compressible fluid due to temperature changes. In certain embodiments, the temperature compensator can include a tube having opposing first and second ends, and an elongated through portion extending therebetween. A flange can extend radially from the first end of the tube and be configured for sliding engagement within a recuperator cylinder of the soft recoil system. A one-way valve can be coupled to the flange at the first end and configured to restrict fluid entry to the elongated through portion via the first end.

22 Claims, 12 Drawing Sheets

TEMPERATURE COMPENSATOR FOR ARTILLERY SYSTEM

FIELD

The described embodiments relate generally to recoil systems for weaponry. More particularly, the present embodiments relate to systems and methods for controlling compressible flow in a recoil system.

BACKGROUND

In artillery systems, compressible fluid can be used to move components of a recoil system in order to counteract various forces associated with firing a weapon. For example, a volume of compressible fluid can be displaced in order to move a recoil rod and induce a momentum generally counteracting forces associated with firing a round of the weapon. However, ambient conditions can change a volume of the compressible fluid, which in turn can modify the momentum of recoiling components. An increase or decrease in temperature, for example, can cause the fluid to expand or contract, respectively. Therefore, in traditional systems, the momentum of the recoiling parts can be susceptible to environmental changes, including temperature increases from use of the weapon system, and as such, the induced momentum may be inappropriate for a given operational condition. As such, the need continues for systems and techniques to regulate compressive fluid volume in a recoil system.

SUMMARY

Embodiments of the present invention are directed to a temperature compensator and methods of use thereof in a recoil system. The recoil system can generally be used to counteract forces associated with firing a round of a weapon system, such an artillery-type weapon. The recoil system can employ compressible fluid, such as a compressible oil, in order to drive a recoil rod or other component in a direction that induces a momentum in the weapon system that generally opposes the momentum induced by firing the round. The momentum at which the recoil rod is driven can therefore be based on a volume of the compressible fluid displaced, among other factors. Ambient conditions, such as temperature variations, can increase or decrease the volume of the compressible fluid. Failing to account for possible variations in compressible fluid volume could cause the recoiling parts to be driven with excessive momentum, such as where excess heat expands the compressible fluid volume.

The temperature compensator of the present disclosure allows a recoil system to regulate the volume of compressible fluid used to displace the recoil components. More particularly, the temperature compensator can limit the total volume of compressible fluid used to displace the compressible fluid, limiting the momentum of the recoiling parts to an appropriate or a desired level. The temperature compensator can thus allow a weapon system to be subjected to high-heat ambient and operational conditions (e.g., heat generated by successive quick-fires), without such conditions contributing to excess recoil momentum.

For example, the recoil system can employ a floating piston to drive the compressible fluid from a recuperator cylinder and into a recoil cylinder. The recoil cylinder generally houses the recoil rod and/or other recoiling components. The volume of compressible fluid displaced from the recuperator cylinder can depend on a travel length of the floating piston associated with evacuating some or all of the compressible fluid from the recuperator cylinder. The temperature compensator disclosed herein generally operates to limit the travel of the floating piston within the recuperator cylinder to a predetermined length or distance. As such, the temperature compensator permits release of a defined volume of compressible fluid from the recuperator cylinder, notwithstanding a potentially increased volume of the compressible fluid in the recuperator cylinder due to expanded volume by ambient temperature increase. Upon recoil of the weapon, the temperature compensator also facilitates compressible fluid flow from the recoil cylinder and back into the recuperator cylinder. For example, various flow control features, such as one-way valves, can alternate to permit flow back into the recuperator cylinder at a rate that moves the floating piston to an appropriate position for firing a subsequent round.

While many examples are described here, in one embodiment, a soft recoil system for a gun is disclosed. The system includes a recuperator cylinder fluidly connected to a recoil cylinder. The recoil cylinder houses a slideable recoil rod that counteracts a force associated with firing a round. The system further includes a floating piston positioned within the recuperator cylinder. The system further includes a temperature compensator positioned at least partially within the recuperator cylinder and arranged between the floating piston and the recoil cylinder. The temperature compensator is configured to alternate between: (i) a first configuration in which the temperature compensator limits a volume of fluid the floating piston drives toward the recoil cylinder, and (ii) a second configuration in which the temperature compensator permits fluid flow therethrough for driving the floating piston away from the recuperator cylinder.

In another embodiment, the recuperator cylinder can have an outlet fluidly coupling the volume of fluid with the recoil cylinder. The temperature compensator can be engageable with the outlet to restrict fluid flow therethrough. The temperature compensator can be immersed with the volume of fluid. With this, the floating piston can define a boundary within the recuperator cylinder between the volume of fluid and a pressurizable zone. The pressurizable zone can be adapted to expand, forcing the volume of fluid toward the outlet via the floating piston.

In another embodiment, the temperature compensator can include a flange slidably engaged with an interior of the recuperator cylinder and moveable therein to a position adjacent to and covering the outlet. The temperature compensator can further include a tube extending from the flange and slideable through the outlet, the tube defining an elongated through portion permitting fluid flow through the temperature compensator. In some cases, the tube can define a free end opposite the flange that can be positioned within a transfer manifold. The transfer manifold can be fluidly coupled with the recoil cylinder. The elongated through portion can be open at the free end. Accordingly, the tube can include a tube wall having a slot extending therethrough fluidly coupling an exterior of the tube wall with the transfer manifold via the elongated through portion.

In another embodiment, the temperature compensator can include a one-way valve configured to restrict fluid flow through the temperature compensator in response to the volume of fluid moving toward the recoil cylinder. The one-way valve can be further configured to increase fluid flow through the temperature compensator in response to the volume of fluid moving away from the recoil cylinder. In some cases, the temperature compensator can define an elongated through portion along an axis of the recuperator cylinder. The one-way valve can be operable to overlap the elongated through portion in the first configuration, and in the second configuration, expose an entire cross-dimension of the through portion to the floating piston.

In another embodiment, a temperature compensator for regulating compressible flow in a soft recoil system is disclosed. The temperature compensator includes a tube having opposing first and second ends. The tube includes an elongated through portion extending between the opposing first and second ends. The temperature compensator further includes a flange extending radially from the first end of the tube and configured for sliding engagement within a recuperator cylinder of the soft recoil system. The temperature compensator further includes a biasing element associated with the tube and compressible against the flange as the second end moves away from the recuperator cylinder. The temperature compensator further includes a one-way valve coupled to the flange at the first end and configured to restrict fluid entry to the elongated through portion via the first end.

In another embodiment, the flange defines a face adapted to extend across a diameter of the recuperator cylinder. In this regard, the elongated through portion extends through the face. In some cases, the one-way valve can be arranged at the face and covering the through portion, in a first configuration. Further, the one-way valve can include a pair of articulable doors moveable from a closed position covering the through portion in the first configuration, to an open position in which the one-way valve completely uncovers the through portion at the face. The flange can define one or more ports about the through portion, providing fluid flow through the flange independent of a configuration of the one-way valve.

In another embodiment, the tube can define slots adjacent the flange and extending into the through portion. The second end can be moveable through a transfer manifold fluidly coupled with a recoil cylinder. In such configuration, the recoil cylinder can house a slideable recoil rod that counteracts a force associated with firing a round. The slots can define a flow path from within the recuperator cylinder adjacent the flange to within the transfer manifold. In some cases, the biasing element can include a spring with the tube extending therethrough. The spring can be configured to bias the temperature compensator away from the transfer manifold.

In another embodiment, a method for regulating compressible fluid flow in a soft recoil system is disclosed. The method includes slideably engaging a floating piston and a temperature compensator within a recuperator cylinder. The recuperator cylinder is fluidly couplable with a recoil rod separated from the floating piston by the temperature compensator. The method further includes using the floating piston to displace a volume of fluid out of the recuperator cylinder to move the recoil rod. The volume of fluid can be limited by a travel of the temperature compensator at least partially out of the recuperator cylinder. The method further includes defining a reverse flow path for the fluid through the temperature compensator to move the floating piston away from the recoil rod.

In another embodiment, the floating piston can define a boundary between the volume of fluid and a pressurizable zone within the recuperator cylinder. Further, the operation of using the floating piston can include moving the floating piston toward the temperature compensator by expanding the pressurizable zone, thereby driving the volume of fluid out of the recuperator cylinder. In this regard, the method can further include engaging an outlet of the recuperator cylinder with the temperature compensator, in response to the movement of the floating piston.

In another embodiment, the temperature compensator can include a flange having a surface facing the floating piston and extending across a diameter of the recuperator cylinder. The surface can restrict flow through the flange and be configured to move the temperature compensator in response to the floating piston driving the volume of fluid out of the recuperator cylinder. In some cases, the operation of defining the reverse flow path can include opening a one-way valve configured to permit flow of the volume of fluid along the reverse flow path through the temperature compensator. In this regard, the operation of slideably engaging can include mounting the floating piston and the temperature compensator at a position within the recuperator cylinder using circumferential sealing elements.

In addition to the exemplary aspects and embodiments described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like structural elements, and in which.

Figure 1:
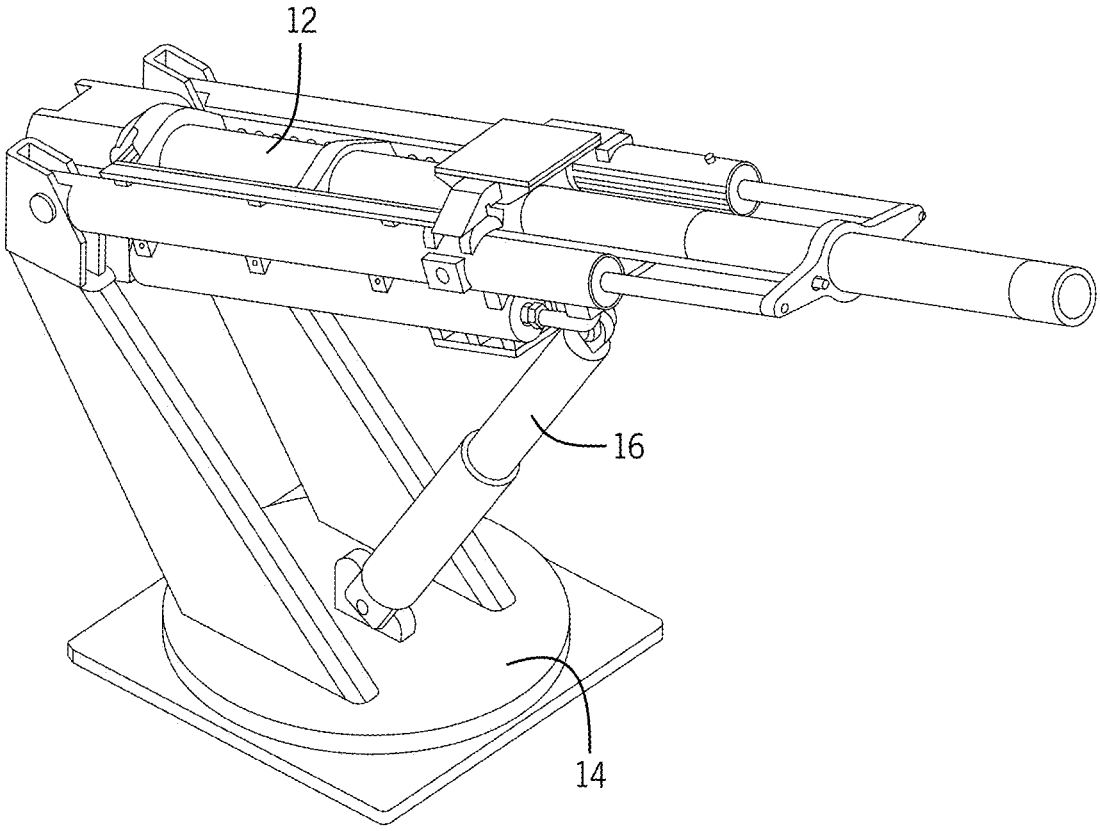
FIG. 1 depicts a sample gun having a soft recoil system.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various examples described herein and, accordingly, may not necessarily be presented or illustrated to scale, and are not intended to indicate any preference or requirement for an illustrated example to the exclusion of examples described with reference thereto.

DETAILED DESCRIPTION

The description that follows includes sample systems, methods, and apparatuses that embody various elements of the present disclosure. However, it should be understood that the described disclosure may be practiced in a variety of forms in addition to those described herein.

The present disclosure describes systems, devices, and techniques related to controlling compressible fluid flow in a recoil system. A recoil system can include a collection of components, assemblies, and subassemblies that cooperate to counteract the force associated with firing a round, such as that from an artillery-type weapon. A recoil rod, as one example, can be driven in a direction that induces momentum in a direction that generally opposes a momentum induced from firing the round. The recoil rod, or other recoil component, can be driven by displacing a compressible fluid into a cylinder or other housing that holds the recoil component. For example, a compressive fluid can be arranged with a recuperator cylinder fluidly connected to the recoil cylinder and a floating piston can operate to drive the compressible fluid from the recuperator cylinder and into the recoil cylinder. However, temperature changes, such as those due to environmental conditions and/or system conditions (e.g., successive firings), can expand the compressible fluid within the recuperator cylinder and increase a potential travel of the floating piston. Left unmitigated, the floating piston could drive an excessive volume of compressible fluid into the recoil cylinder, inducing a momentum for the associated recoiling components that could be inappropriately high or otherwise unsuited for counteracting the recoil forces associated with firing the round.

The temperature compensator of the present disclosure can mitigate such issues, allowing the recoil parts to induce a momentum calibrated from the forces associated with firing the round, notwithstanding temperature increases in the compressible fluid used to drive the recoiling components. An artillery or other weapon system can be used in a variety of ambient conditions and operational factors, while maintaining a desired and repeatable amount of recoil for the target round. While many configurations are possible, the temperature compensator is generally arrangeable along a fluid path between the floating piston (driving the compressible fluid) and the recoil cylinder (housing the recoiling components, such as the recoil rod). In a first configuration, described in greater detail below as a "run up phase," the floating piston drives the compressible fluid out of the recuperator cylinder and into the recoil cylinder for driving the recoiling components. In this run up phase, the temperature compensator limits the volume of the compressible fluid that the floating piston is capable of displacing, for example, by defining a physical barrier limiting the travel distance of the floating piston, which limits the flow of compressible fluid through the temperature compensator itself.

Subsequently, in a second configuration, described in greater detail below as "recoil phase," the compressible fluid returns to the recuperator cylinder from the recoil cylinder. The temperature compensator facilitates moving the floating piston towards its initial position by increasing the flow of compressible fluid through the temperature compensator using one or more flow control elements. The multi-configuration operation of the temperature compensator not only allows compressible fluid to be regulated exiting the recuperator, but also permits return and substantial equalization of the recoil system components in preparation for firing a subsequent round.

To facilitate the foregoing, the temperature compensator can be provided with a flange slidably engageable with the recuperator cylinder. The temperature compensator can further include a tube having a first end connected to the flange that extends elongated from the first end to define a second, free end. The flange is arranged along a fluid path between the floating piston and the recuperator cylinder and can generally be adapted to respond to a change in fluid pressure within the recuperator cylinder caused by movement of the floating piston. In this regard, the floating piston can cause the temperature compensator to move along a fluid path towards the recoil cylinder as the floating piston displaces the compressible fluid. During such movement, the temperature compensator can engage an outlet of the recuperator cylinder fluidly connected to the recoil cylinder, controlling flow therethrough. Movement of the temperature compensator fluidly towards the recoil cylinder can be limited by the recuperator cylinder and associated geometries, as described herein, allowing the temperature compensator to "bottom out" at or near an outlet of the recuperator. This can provide resistance and a physical barrier with which to slow and stop the advancement of the floating piston, and thus limit the volume of compressible fluid that the floating piston is able to displace.

For example, at least the flange of the temperature compensator is positioned within the recuperator cylinder. The flange is prevented from exiting from the recuperator cylinder as the outlet of the recuperator cylinder is smaller than the flange. The tube of the temperature compensator, however, is connected with the flange at the first end and capable of sliding engagement with the outlet. As such, the tube is arranged at least partially outside the recuperator cylinder and within a transfer manifold, which fluidly connects the recuperator cylinder and the recoil cylinder. To facilitate compressive fluid flow into the transfer manifold, the tube can define an elongated through portion open at the second, free end, in addition to various slots arranged along an exterior of the tube and extending into the elongated through portion. The tube can thus define a flow path for compressible fluid from a region of the recuperator cylinder at an exterior of the tube (such as adjacent the flange) and into the tube and to the transfer manifold during the run up phase of firing. The flange can also permit fluid flow therethrough during the run up phase, with ports arranged through a thickness of the flange, and having a diameter that is less than that of the tube, such as having a diameter that is substantially less than a diameter of the tube.

During the recoil phase, the temperature compensator increases a potential volume of fluid that can pass through the flange and tube. To facilitate this, the elongated through portion can define an opening on a surface that faces the floating piston within the recuperator cylinder. The elongated through portion extends to the opening, establishing a flow path from the surface of the flange to the second, free end of the tube. In the run up phase described above, the opening is covered and at least partially sealed by a flow control element, such as a one-way valve, and the compressible fluid is substantially blocked from traveling through the opening as the floating piston operates to displace the compressible fluid out of the recuperator cylinder. In the recoil phase, as compressible fluid reenters the recuperator cylinder, the flow control element substantially uncovers the opening at the flange, allowing the compressible fluid to flow therethrough. This increased flow through the temperature compensator via the one-way valve can help move the floating piston toward an initial or latch position, using the pressure from the returning compressible fluid, as described herein.

Various other components, assemblies, and subassemblies are described herein to facilitate the operation of the temperature compensator and associate recoil and artillery systems, as will be appreciated by study of the description herein. For example, the temperature compensator can include a spring or other biasing element that facilitates movement of the flange away from the outlet of the recuperator cylinder. The spring can provide a biasing force that encourages the temperature compensator to move toward an initial or latch position. The biasing force can enhance or augment the movement afforded by fluidic pressure changes in the compressible fluid. This can be beneficial, for example, in a "counter recoil" phase, or other phase of operation, in which the compressible fluid may be returning to a baseline pressure or flow. As another example, systems and techniques are provided to detect, tune, or control the temperature compensator, including using a magnetic-based detection sensor, to identify a position of the temperature compensator in the recuperator cylinder, among other possibilities.

Reference will now be made to the accompanying drawings, which assist in illustrating various features of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

The term "recoiling parts" as used herein generally refers to those elements of a piece of a gun 12 and/or a recoil system 10 that move in response to the energy of expending a round in the gun 12. This term may encompass, but is not limited to, the barrel 20, muzzle brake, breech 24, first rail 28, second rail 30, rear yoke 32, middle yoke 34, forward yoke 36, muzzle yoke 38, flange 39, tie rod 40, first recoil rod 52, second recoil rod 62, and recoil piston 64 (although the recoil rods 52, 62 and recoil piston 64 may also be considered as part of the soft recoil system 10).

One embodiment of an artillery weapon, such as a howitzer (or more generally, gun 12), may be mounted to a base 14 and include the recoil system 10 as shown in FIG. 1. The base 14 may be rotatable with respect to the structure to which it is mounted to allow a user to change the orientation of the gun 12. The actuator 16 may be cooperatively engaged at a first end thereof with the base 14 and at a second end thereof with a portion of the gun 12 to adjust the vertical angle of the gun 12 with respect to the base 14. Other structures and/or methods may be used to change the orientation of the gun 12 without limitation, and will not be discussed further herein for purposes of brevity. The soft recoil system 10 may be mounted in any manner suitable for the use for which the gun 12 is designed. Such mountings include, but are not limited to, vehicle mounts, chassis mounts, and skid mounts.

Figure 2:
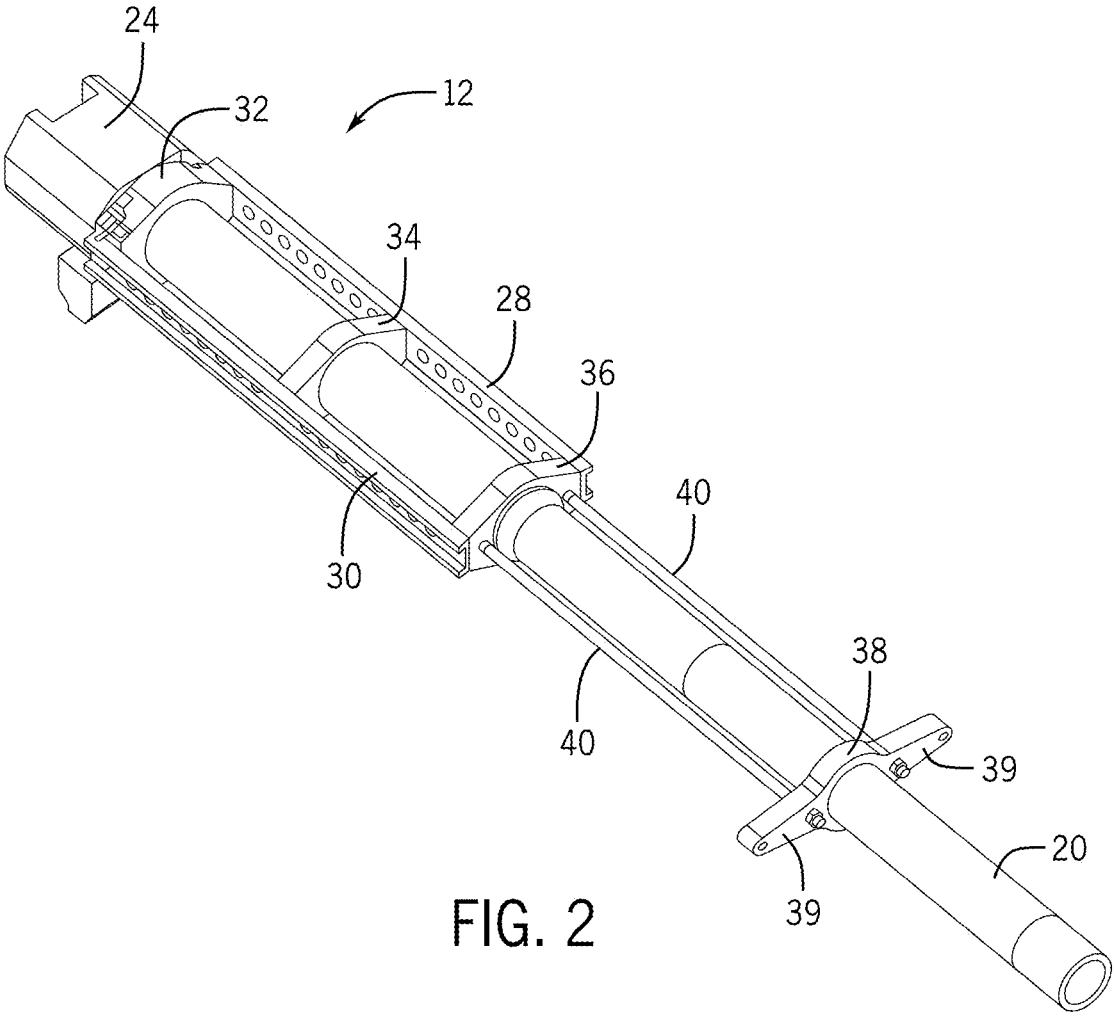
FIG. 2 depicts the sample gun of FIG. 1.

A gun 12 without the soft recoil system 10 and removed from a base 14 is shown in FIG. 2. The gun 12 generally includes an elongated, hollow barrel 20 through which a shell/cartridge/round is fired. The barrel 20 may include a muzzle brake (not shown) at its forward end, and a breech 24 at its rearward end. Rails or channels 28, 30 may be positioned on opposite sides of the barrel 20 and extend parallel to the longitudinal axis of the barrel 20. The rails may be firmly retained in place by a plurality of yokes 32, 34, 36; a first or rear yoke 32, a second or middle yoke 34, and a third or forward yoke 36 attached to an intermediate portion of the barrel 20. The yokes 32, 34, 36 circumferentially clasp or are secured to the barrel 20 at positions along its longitudinal axis. The forward yoke 36 may include a latch point 36 to provide an interface between the recoiling parts and a latch mechanism.

In addition, a muzzle yoke 38 may circumferentially clasp an intermediate portion of the barrel 20 at a position that is spaced from and forward of the third yoke 36. The muzzle yoke 38 may be configured to include a pair of opposed end portions or flanges 39, which extend generally transverse to the longitudinal axis of the barrel 20 as shown in FIG. 2. Each flange 39 may be formed with a cylindrical-shaped bore or passage formed therein, wherein the central axis of the passages may extend generally parallel to the longitudinal axis of the barrel 20. At least one tie rod 40, two of which are shown in FIG. 2, may be disposed on opposite sides of the barrel 20. Each tie rod 40 may extend through aligned apertures in yoke 32, 34, and/or 36 and flanges 39 of muzzle yoke 38. The tie rods 40 may be retained in position by a suitable attaching member, such as a lock nut, welding, or other structures and/or methods suitable to the particular embodiment of the gun 12. In the illustrative embodiment of the soft recoil system 10, two tie rods 40 are simultaneously engaged with the forward yoke 36 and the muzzle yoke 38. However, the soft recoil system 10 may include tie rods 40 engaging other and/or additional yokes 32, 34, 36, and 38 without limitation. Alternatively, muzzle yoke 38 may be mounted directly to barrel 20 without tie rods 40.

Figure 3:
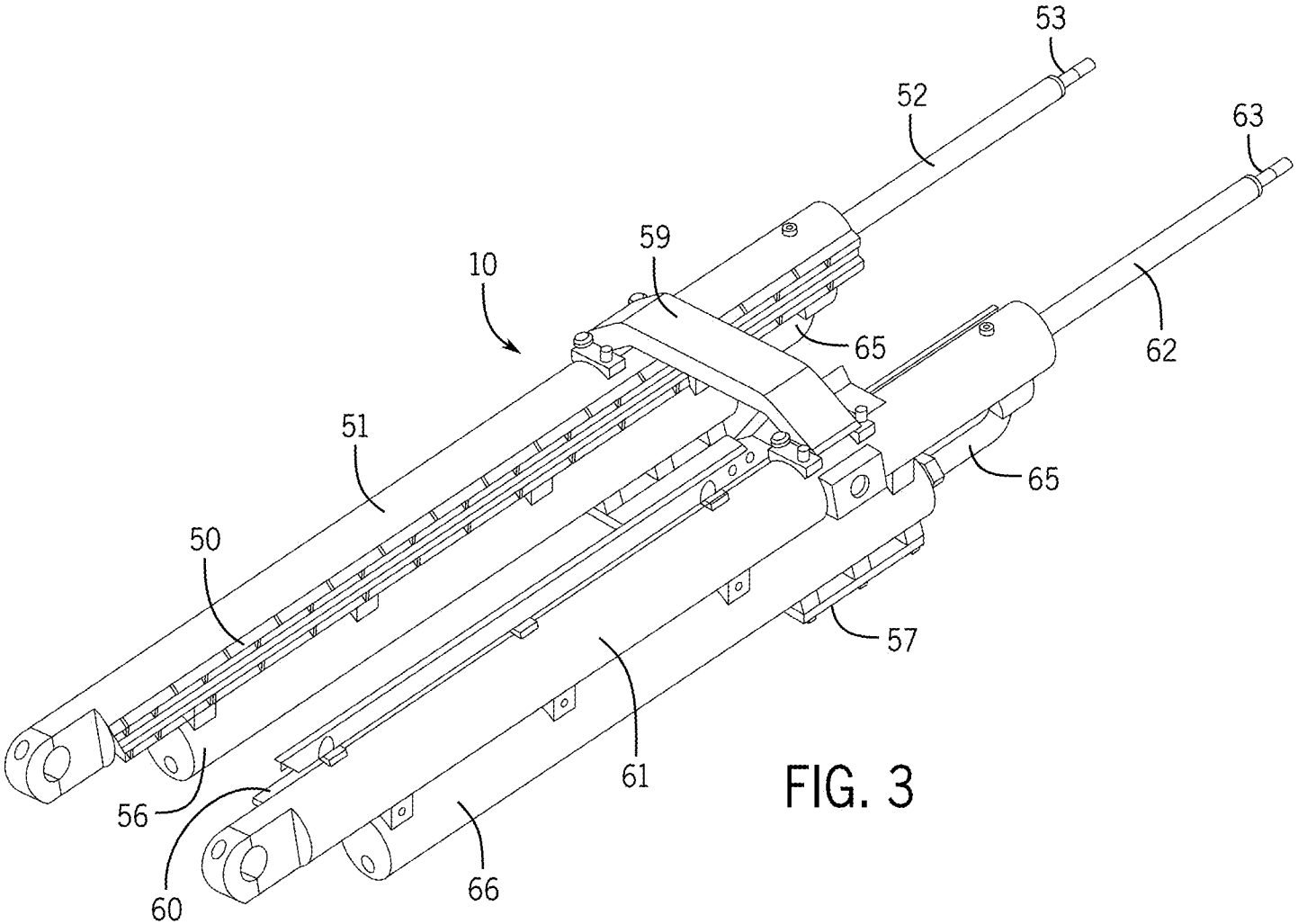
FIG. 3 depicts the soft recoil system of FIG. 1.

FIG. 3 provides a perspective view of the recoil system 10 having a cradle configuration for use with the embodiment of a gun 12 shown of FIG. 2. To provide recoil control, the illustrative embodiment of the recoil system 10 is formed with two hydro-pneumatic systems that are essentially mirror images of one another about a vertical plane longitudinally bisecting the recoil system 10. The illustrative embodiment of a recoil system 10 includes a pair of elongate recoil cylinders 51, 61, which have longitudinal axes that are generally parallel to each other. The recoil cylinders 51, 61 are supported in a spaced-apart configuration by a crossover bracket 59 on the top side and a mounting bracket 57 on the bottom side. In one embodiment of a recoil system 10 when compared to the prior art, the recoil system 10 increases the window of velocities that may be successfully fired for a particular zone/charge, decreases the maximum velocity necessary to successfully fire the top charge (thereby reducing the misfire forces), and provides throttling capability over the entire stroke length (thereby reducing overload forces).

Each recoil cylinder 51, 61 may be hydro-pneumatically linked to an associated gas reservoir or recuperator 56, 66 through a fluid transfer manifold, where only fluid transfer manifold 65 for the second recoil cylinder 61 and recuperator 66 is shown in FIG. 3. A first and second rail guide 50, 60 may be affixed to opposed inner surfaces of the first and second recoil cylinders 51, 61, respectively. The rail guides 50, 60 may be configured to be respectively slideably engaged with the rails 28, 30 affixed to the barrel 20 as shown in FIG. 2. This allows the recoiling parts to move linearly with respect to the non-recoiling parts along the rails 28, 30 and rail guides 50, 60. The crossover bracket 59, which is designed to straddle the barrel 20, may include an underside surface configured to mate with the curved upper surface of the barrel 20.

In another embodiment of the soft recoil system 10, only a single recoil cylinder 61 and recuperator 66 are used. In this embodiment, the recoil cylinder 61 and recuperator 66 may be positioned parallel with respect to the barrel 20 of the gun 12 to which the soft recoil system 10 is cooperatively engaged. It is contemplated that in such an embodiment of a soft recoil system 10 it will be advantageous to position the recoil cylinder 61 and/or recuperator 66 either directly above or directly below the barrel 20 such that a vertical plane will bisect the barrel 20, recoil cylinder 61, and recuperator 66. However, other configurations and/or orientations may be used without limitation.

The recoil system 10 may include a pair of recoil rods 52, 62, which may be positioned within and extend from the forward ends of the recoil cylinders 51, 61. When the recoil system 10 is fitted onto the gun 12 of FIG. 1, the forward ends 53, 63 of the recoil rods 52, 62 are fitted into the apertures formed in the flanges 39 of the muzzle yoke 38. In the illustrative embodiment of the recoil system 10, the recoil rods are pneumatically/hydraulically driven, as described in detail below.

Figure 4:
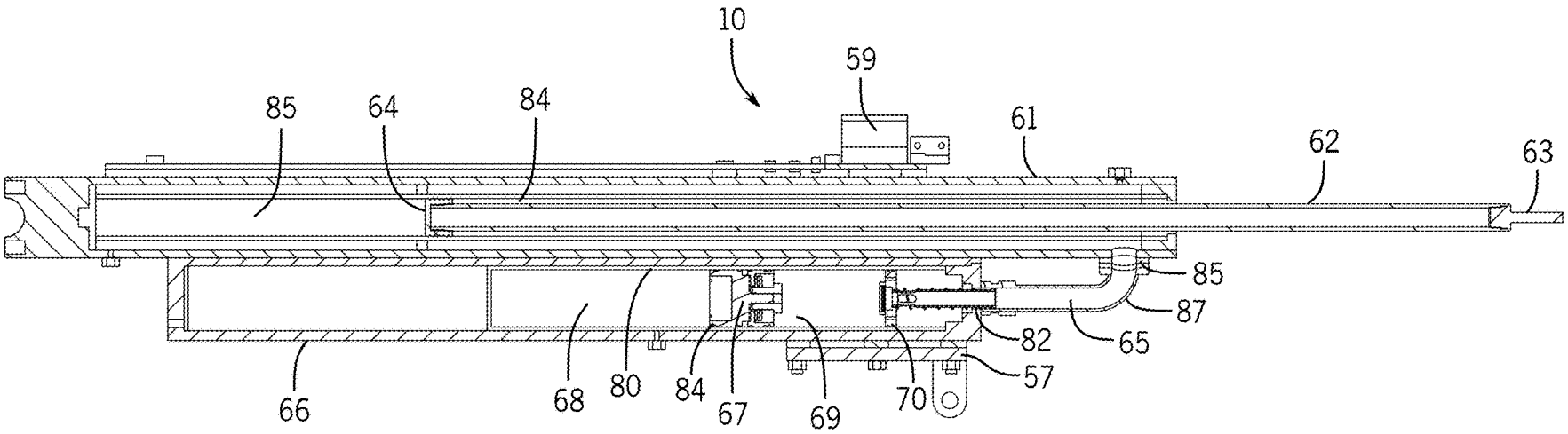
FIG. 4 depicts a cross-sectional view of the soft recoil system of FIG. 3, taken along line 4-4 of FIG. 3.

FIG. 4 shows a cross-sectional view of the soft recoil system 10 along the longitudinal axis of the recuperator 66 and recoil cylinder 61. It will be appreciated that the following discussion can be applicable to the recuperator 56 and recoil cylinder 51, as may be appropriate for a given application. As illustrated in the cross-sectional view of FIG. 4, the recuperator 66 is fluidly connected to the recoil cylinder 61 via a transfer manifold 65. The recuperator 66 can be configured to hold a volume of compressive fluid, such as a compressible oil. The recuperator 66 has an outlet 80. The outlet 80 can include a reduced width portion of the recuperator 66. As described in greater detail below with respect to FIG. 8, the outlet 80 can define or otherwise be associated with recessed portions within the recuperator 66, at which the width of the recuperator 66 is reduced gradually and/or stepwise to a width of the outlet 80. The outlet 80 is connected to the transfer manifold 65. The transfer manifold 65 can be a pipe, tube, conduit, or other section of the recoil system that transfers compressible fluid from the recuperator 66 to the recoil cylinder 61. The transfer manifold 65 can therefore be defined by a variety of geometries in order to fluidly couple the recuperator to the recoil cylinder 61, as may be appropriate for a given application. In the embodiment shown in FIG. 4, the recoil cylinder 61 includes an intake 85. The transfer manifold is connected to the intake 85 and the outlet 82, and as such, include a bend 87 along a fluid path defined by the transfer manifold; however, this is not required. In other cases, the transfer manifold 65 can be coupled with other elements, including other piping assemblies, valves, controls, and so on, as may be appropriate for a given application.

FIG. 4 also shows a floating piston 67. The floating piston 67 is positioned within the recuperator cylinder 66. The floating piston 67 is generally configured to slide within the recuperator cylinder 66, and thus can be engaged with an interior 80 of the recuperator. In one embodiment, the floating piston 67 can divide the recuperator cylinder 66 into separate first and second recuperator chambers 68, 69. Liquid, vapor, or gas can be positioned in either recuperator chamber 68, 69. The first recuperator chamber 68 can be filled with nitrogen or another compressible gas capable of acting as a fluid spring in conjunction with the floating piston 67. In turn, the second recuperator chamber 69 can be filled with an inert oil or other lubricating substance for the particular embodiment of the recoil system 10. Circumferential sealing elements 84, is some embodiments, can be used to separate the first recuperator chamber 68 and the second recuperator chamber 69 from one another.

Within the first recuperator chamber, FIG. 4 shows a temperature compensator 70, such as the temperature compensator discussed above and described in greater detail below. The temperature compensator 70 can be positioned along a fluid path defined between the floating piston 67 and the recoil cylinder 61. The temperature compensator 70 is slideably engaged with the interior 80 of the recuperator 66. In some cases, the temperature compensator 70 can include circumferential sealing elements 84. A portion of the temperature compensator 70 extends through the outlet 80 and is slideable therethrough.

As described in greater detail below, the first recuperator chamber 68 can define a pressurizable zone of the recuperator 66. For example, the compressible gas or other fluid that defines the fluid spring can be charged, released, or otherwise activated in order to increase a pressure within the first recuperator chamber 68. The pressure can increase to a threshold value in which the recoil system can initiate a process of displacing the inert oil from the second recuperator chamber 69. In this regard, the pressurized first recuperator chamber 68 can cause the floating piston 67 to move towards the outlet 82, thus displacing the inert oil held substantially between the floating piston 67 and the outlet 82 from the recuperator 66. The temperature compensator 70 is arranged substantially between the floating piston 67 and the outlet 82, in the inert oil or other fluid. The temperature compensator 70 defines a physical barrier limiting the volume of the inert oil displaceable by the floating piston. The displaceable inert oil exits the recuperator 66 and travels into the recoil cylinder 61 via the transfer manifold 65. The buildup of the inert oil in the recoil cylinder 61 can in turn cause the recoil rod to move, inducing the momentum tailored toward counteracting the forces associating with firing the accompanying weapon.

Figure 5A:
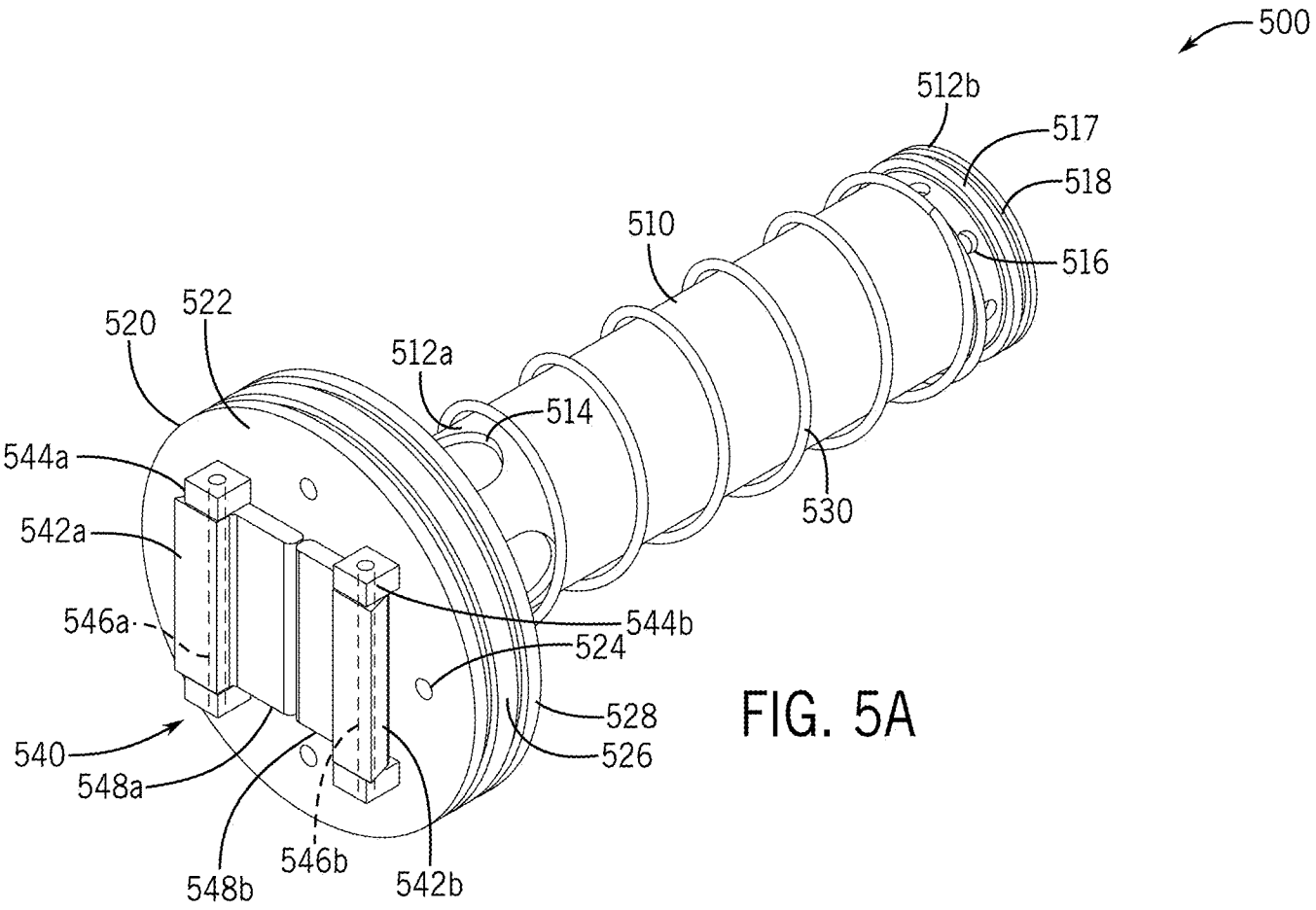
FIG. 5A depicts a temperature compensator in a first configuration.
Figure 5B:
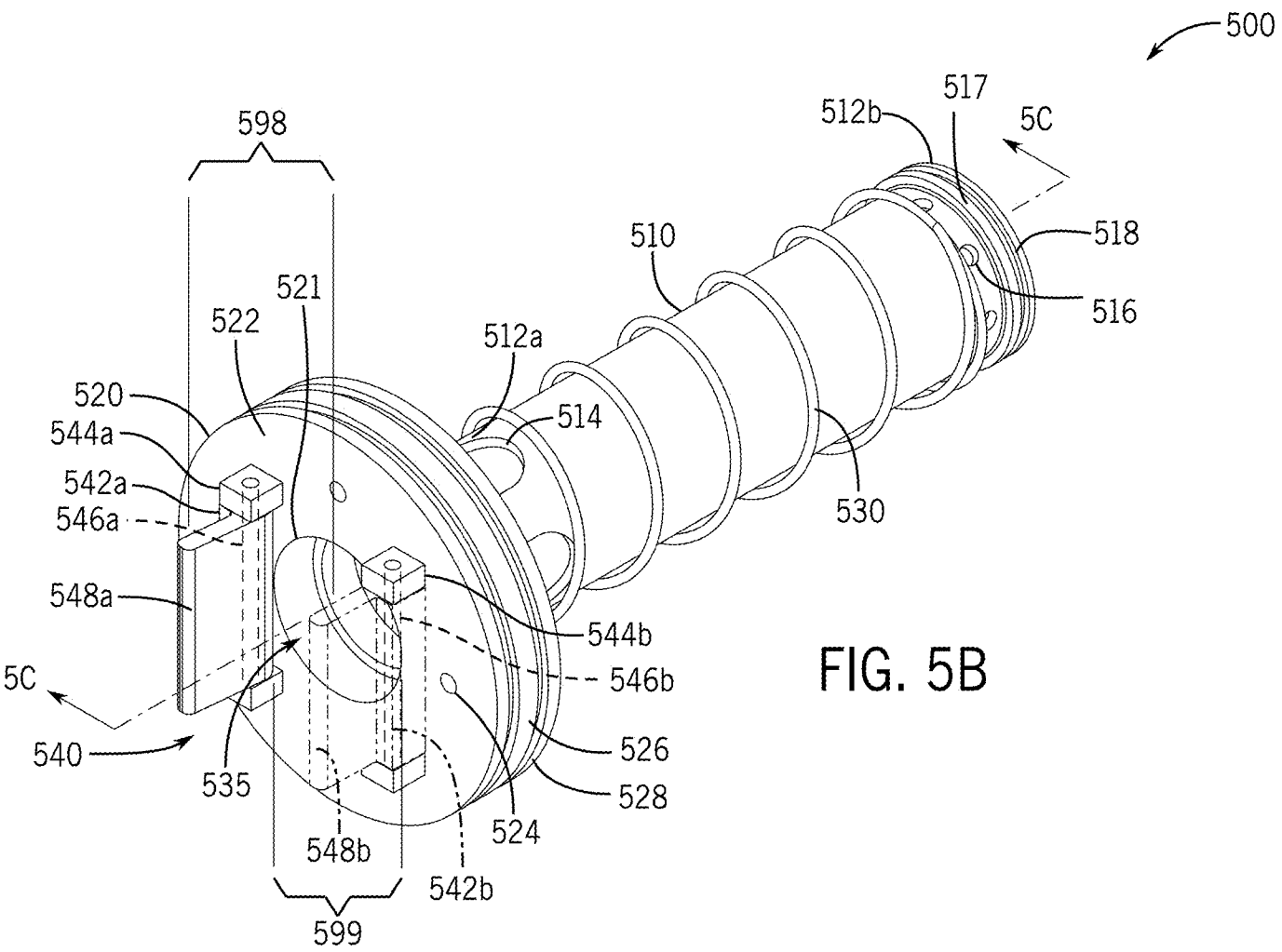
FIG. 5B depicts the temperature compensator of FIG. 5A in a second configuration.
Figure 5C:
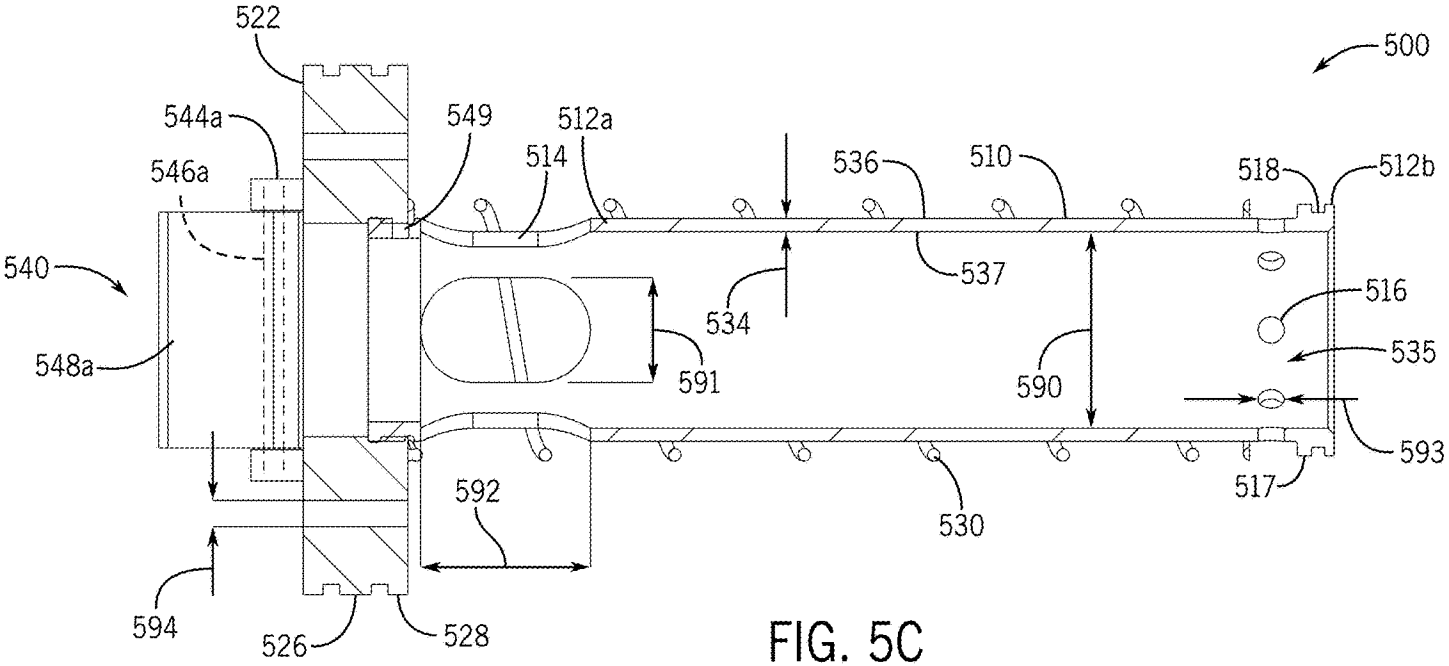
FIG. 5C depicts a cross-sectional view of the temperature compensator in the second configuration of FIG. 5B, taken along line 5C-5C of FIG. 5B.

FIG. 5A-5C depict an embodiment of a temperature compensator, according to one or more embodiments of the present disclosure. In particular, a temperature compensator 500 is shown, which can be substantially analogous to the various temperature compensators described herein. For example, the temperature compensator 500 can be used to regulate compressible fluid flow within a recoil system. The temperature compensator 500 is adapted to define a physical barrier between a floating piston (for driving compressible fluid) and a recoil cylinder (for housing recoil components). The temperature compensator 500 is further adapted to define a reverse flow path for the compressible fluid, allowing the compressible fluid to return the floating piston to an initial or latch position. It will be appreciated that while FIGS. 5A-5C present various structures and configurations of the temperature compensator 500, these are shown for purposes of illustration. In other cases, other structures can be used to perform similar functions, as contemplated herein.

In the embodiment of FIGS. 5A-5C, the temperature compensator 500 includes a tube 510. The tube 510 can be a substantially hollow and elongate structure having a first tube end 512*a* and a second tube end 512*b*. For example, the tube 510 can be defined by a tube wall 534 that forms a substantially cylindrical shape extending along a longitudinal axis of the temperature compensator 500. The tube 510 defines an elongated through portion 535 extending between the first end 512*a* and the second end 512*b* and arrangeable along the longitudinal axis. The elongated through portion 535 defines a flow path through the tube 510, such as defining a flow path between the first end 512*a* and the second end 512*b*.

The tube 510 can also include a variety of slots extending through the tube wall 534. In the example of FIGS. 5A-5C, the tube can include a series of first end slots 514 and a series of second end slots 516. The first end slots 514 and the second end slots 516 can extend through the tube wall 534 and into the elongated through portion. For example, the first end slots 514 and the second end slots 516 can extend from an exterior 536 of the tube 510 to an interior 537 of the tube 510. The slots 514, 516 define a flow path for fluid from a region outside the tube 510 (e.g., along the exterior 536) to a region inside the tube 510 (e.g., along the interior 537, such as being with the elongated through portion 535).

While many configurations are possible, the slots 514, 516 can be dimensioned to induce certain fluid properties and flow paths relative to the temperature compensator 500 and with respect the various operational conditions or phases of the recoil system of the present disclosure. For example, the first end slots 514 can have a first slot width 591 and a first slot length 592 generally larger than the first slot width 591. One or more of the first end slots 514 can therefore be defined by an oval or oblong shape near the first end 512*a*. The second end slots 516 can have a cross-dimension 593 defining a diameter of the second end slots 516. As shown in FIGS. 5A-5C, the cross-dimension 593 can generally be less than one or both of the first slot width 591 and the first slot length 592. In this regard, the tube 510 can be adapted for a greater volumetric flow through the tube wall 534 near the first end 512*a* as compared with the volumetric flow afforded by the second slots 516.

The tube 510 can generally define the elongated through portion 535 as having a width 590. In the case where the tube 510 is substantially cylindrical, the width 590 can represent a diameter of the tube 510. The width 590 is configured to accommodate compressible fluid flow through the tube 510. The width 590 allows sliding engagement of the temperature compensator 500 with the outlet of the recuperator and transfer manifold (e.g., outlet 80 and transfer manifold 65 of FIG. 4). For example, the tube 510 is sized to sufficiently slide through the outlet of a recuperator without substantially impeding its movement. The tube 510 can further include features to facilitate the engagement of the temperature compensator with the outlet and the transfer manifold.

For example, FIGS. 5A-5C show the tube as including a manifold engagement feature 517 near the second end 512*b*. The manifold engagement feature 517 can be a raised surface or collar that protrudes radially from the exterior 536 of the tube 510. In this regard, the manifold engagement feature 517 can be received within the transfer manifold and have a cross-dimension larger than a cross-dimension of the outlet of the recuperator. This can help mitigate reentry of the temperature compensator 500 into the recuperator, for example, during a recoil or other phase in which the temperature compensator 500 is biased fluidly away from the recoil cylinder. The manifold engagement feature 517 is also show as defining various sealing element retainers 518. The sealing element retainers 518 can be adapted to receive one or more circumferential sealing elements, such as an O-ring, which can be constructed from a synthetic material. For example, the sealing elements retainers 518 can be grooves or channels formed into a surface of the manifold engagement feature 517 and have a sufficient depth to generally restrain movement of the sealing elements during sliding movement of the temperature compensator 500 within the transfer manifold.

The temperature compensator 500 is also shown in FIGS. 5A-5C as including a flange 520. The flange 520 can generally be any appropriate structure that is configured for engagement, such as sliding engagement, along an interior surface of a recuperator cylinder. In this regard, FIGS. 5A-5C show the flange 520 as being a substantially disc-shape feature having an annular circumferential surface adapted to engage the interior of a recuperator cylinder (e.g., such as the recuperator cylinder 66 of FIG. 4). The annular circumferential surface can define or otherwise include a recuperator cylinder engagement feature 526. The recuperator cylinder engagement feature 526 can be a raised or protruding portion of the flange 520, such as where the feature 526 defines a collar; however, this is not required. In other cases, the recuperator cylinder engagement feature 526 can be a continuous extension of a face of the flange that is generally adapted for sliding along the interior of the recuperator cylinder. In some cases, the recuperator cylinder engagement feature 526 can include sealing element retainers 528 that are formed into the recuperator cylinder engagement feature 526. The sealing element retainers 528 can be adapted to receive one or more circumferential sealing elements, such as an O-ring, which can be constructed from a synthetic material. For example, the sealing elements retainers 528 can be grooves or channels formed into a surface of the recuperator cylinder engagement feature 526 and have a sufficient depth to generally restrain movement of the sealing elements during sliding movement of the temperature compensator 500 within the recuperator cylinder.

The flange 520 also include a face 522. The face 522 can be an exterior surface of the flange 520 that is generally arranged toward the floating piston. The face 522 can be adapted to extend substantially across a diameter of the recuperator cylinder, and generally restrict the flow of compressible fluid thereacross. For example, the face 522 can define a physical barrier against which the floating piston displaces compressible fluid toward in order to move the temperature compensator within the recuperator cylinder. The face 522 therefore can define a sufficient surface area such that the compressible fluid displaced by the floating piston causes the temperature compensator to move within the recuperator cylinder.

The flange 520 can also include various openings, holes, ports, and so on in order to facilitate fluid flow through the flange. FIGS. 5A-5C show the flange 520 to include an opening 521 at the face. The opening 521 can extend through a complete thickness of the flange 520 and be arranged along the longitudinal axis of the temperature compensator 500. The flange 520 is also shown as including a series of ports 524 arranged radially about the opening 521. The series of ports 524 can extend through the complete thickness of the flange 520 and having a diameter 594.

The flange 520 and the tube 510 can be connected to one another at mechanical coupling 549. The mechanical coupling 549 can be a threaded connection, a weld, a snap-fit, or other appropriate connection, including a connection facilitated by other fasteners, locks, and so on. It will also be appreciated that while FIGS. 5A-5C show the tube 510 and the flange 520 as being two separate components connected to one another at the mechanical coupling 549, in other cases the tube 510 and the flange 520 can be integrally formed components, such that the tube 510 and the flange 520 are a one-piece structure.

In the embodiment of FIGS. 5A-5C, the flange 520 and the tube 510 are connected to one another at the first end 512*a*. When connected, the elongated through portion 535 of the tube 510 is generally aligned with the opening 521 of the flange 520. The elongated through portion 535 and the opening 521 can therefore define a continuous through passage along the longitudinal axis of the temperature compensator, in certain configurations.

The continuous through passage can also be selectively openable and closeable using various flow control elements. For example, the temperature compensator 500 is shown in FIGS. 5A-5C as including a one-way valve 540 or other flow controller. The one-way valve 540 is positioned at the face 522 of the flange and overlaps some or all of the opening 521. The one-way valve 540 allows the temperature compensator 500 to alternate between at least two configurations. A first configuration, in which the one-way valve 540 generally limits a volume of fluid that can pass through the temperature compensator, and a second configuration, in which the one-way valve 540 increases the volume of fluid that can pass through the temperature compensator. As described in greater detail below with respect to FIGS. 6-9, this dual functionality allows the temperature compensator 500 to restrict a volume of compressible fluid displaceable by the floating piston in the first configuration, and in the second configuration, use the increased fluid flow through the temperature compensator 500 to encourage the floating piston to return to an initial, neutral, or latch position.

To facilitate the foregoing, in the embodiment of FIGS. 5A-5C, the one-way valve 540 includes articulable doors 542*a*, 542*b*. The articulable doors 542*a*, 542*b* can be flat, planar structures defining a physical barrier for fluid flow. For example, the articulable doors 542*a*, 542*b* can include respective flow control portions 548*a*, 548*b*. The flow control portions 548*a*, 548*b* can be flaps or elongated portions of the articulable doors 542*a*, 542*b* configured to cover select openings of the temperature compensator 500, and block fluid flow therethrough, in a first configuration, such as that shown in FIG. 5A. The flow control portions 548*a*, 548*b* can also have a substantially thin profile, allowing the articulable doors to minimally disrupt fluid flow when the articulable doors are arranged substantially in-line with the flow, in a second configuration, such as that shown in FIGS. 5B and 5C.

The one-way valve 540 can include any appropriate structure to facilitate the articulation of the articulable doors 542*a*, 542*b*. For example, the one-way valve 540 can include hinge features 544*a*, 544*b* arranged at the face 522 of the flange 520. The hinge feature 544*a*, 544*b* can be arranged on opposing sides of the opening 521, in certain embodiments. The one-way valve 540 also includes pins 546*a*, 546*b*. The pins 546*a*, 546*b* can be used to pivotally mount the articulable doors 542*a*, 542*b* to the respective hinge feature 544*a*.

The articulable doors 542*a*, 542*b*, the hinge features 544*a*, 544*b*, and the pins 546*a*, 546*b* and/or other associated components can cooperate to articulate the articulable doors 542*a*, 542*b* between a first, closed position and a second, open position. For example, FIG. 5A shows the temperature compensator 500 in a first configuration, in which the articulable doors 542*a*, 542*b* are in the first, closed position. In the first, closed position, the articulable doors 542*a*, 542*b* can overlap some or all of the opening 521 of the flange 520. In this regard, the one-way valve 540 can inhibit fluid flow along the longitudinal axis of the temperature compensator 500. This can be beneficial, for example, during a run up phase, in which the floating piston is used to displace compressible fluid from the recuperator cylinder.

In a subsequent firing phase, such as during a recoil phase, the articulable doors 542*a*, 542*b*, can pivot into the second, open configuration shown in FIG. 5B. In the second, open configuration, the articulable doors 542*a*, 542*b* can clear and expose all or substantially all of a cross-dimension of the opening 521. For example, as shown in FIG. 5B, the opening 521 can have a diameter 599. The articulable doors 542*a*, 542*b* can define a separation 598 in the second, open configuration that is greater than the diameter 599 of the opening 521. As such, the one-way valve 540 can expose the opening 521, thereby permitting maximum fluid flow therethrough, unimpeded by the operation of the one-way valve 540.

As described above, the flange 520 includes the series of ports 524 that can have the diameter 594. The diameter 594 of the ports 524 is less than the diameter 599 of the opening 521 of the flange 520. For example, the diameter 594 of the ports 524 can be substantially less than the diameter 599 of the opening 521, such that the total surface area of all of the series of ports 524 combined, is less than the surface area of the opening 521. Accordingly, the volume of fluid displaceable through the flange 520 can be increased when the one-way valve 540 transitions from the first, closed configuration of FIG. 5A and into the second, open configuration of FIG. 5B.

It will be appreciated that while FIGS. 5A-5C show the one-way valve 540 as including the articulable doors 542*a*, 542*b*, other configurations of valves are possible and contemplated herein. For example, the one-way valve 540 could include or be associated with a ball-type check valve, a diaphragm-type check valve, a tilting-disc-type valve, among other possibilities. In this regard, the one-way valves of the present disclosure can be integrated with the temperature compensator in a variety of manners, including being at least partially seated within the opening 521 of the flange and/or including one or more integrally formed components with the flange 520 or tube 510, such as a seating or mating surface for components of the valve.

Also shown in the embodiment of FIGS. 5A-5C is a biasing element 530. The biasing element 530 is shown associated with the tube 510. For example, the biasing element 530 can be positioned substantially around the tube 510 extending between the first end 512*a* and the second end 512*b*. The biasing element 530 can be a helical spring, and as such, the tube 510 can extend through a center of the helical spring defined by the spring coils. The biasing element 530 can generally be compressible between the flange 520 and the interior of the recuperator cylinder surrounding the outlet (e.g., outlet 82 of FIG. 4).

The biasing element 530 can facilitate movement of the temperature compensator 500 toward the floating piston. As shown in greater detail with respect to FIGS. 6-9 below, the tube 510 of the temperature compensator 500 extends at least partially out of the recuperator cylinder during a run up phase of firing. During this run up phase, the floating piston displaces compressible fluid toward the recoil cylinder and compresses the biasing element 530 between the flange 520 and an interior of the recuperator cylinder. This stores energy within the biasing element 530. In turn, such as during a recoil phase or when the floating piston otherwise ceases displacing fluid, the stored energy of the biasing element 530 can be released, causing the temperature compensator to move away from the outlet of the recuperator cylinder and toward the floating piston. The biasing element 530 can help the recoil system return to an equilibrium of initial, starting state, or otherwise avoid stalling or sticking the temperature compensator at the outlet.

Figure 6:
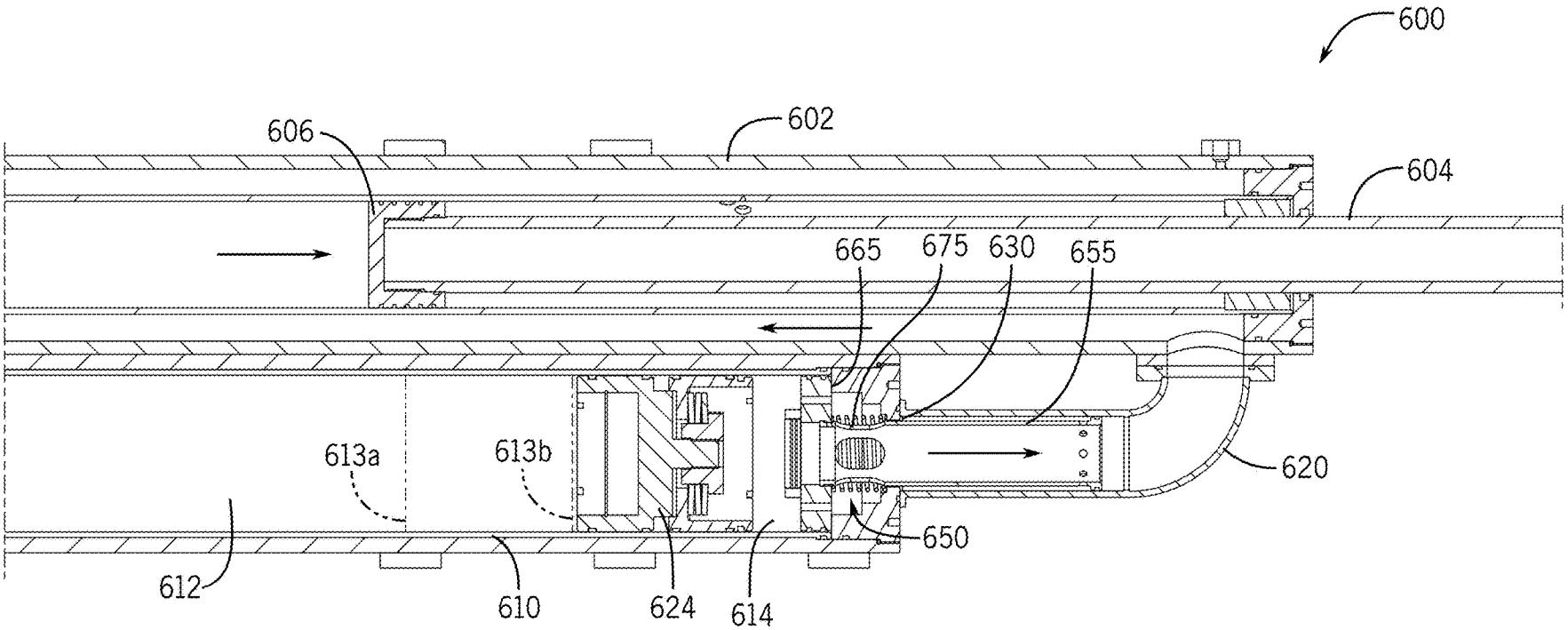
FIG. 6 depicts a cross-sectional view of a soft recoil system during a run up phase.
Figure 7:
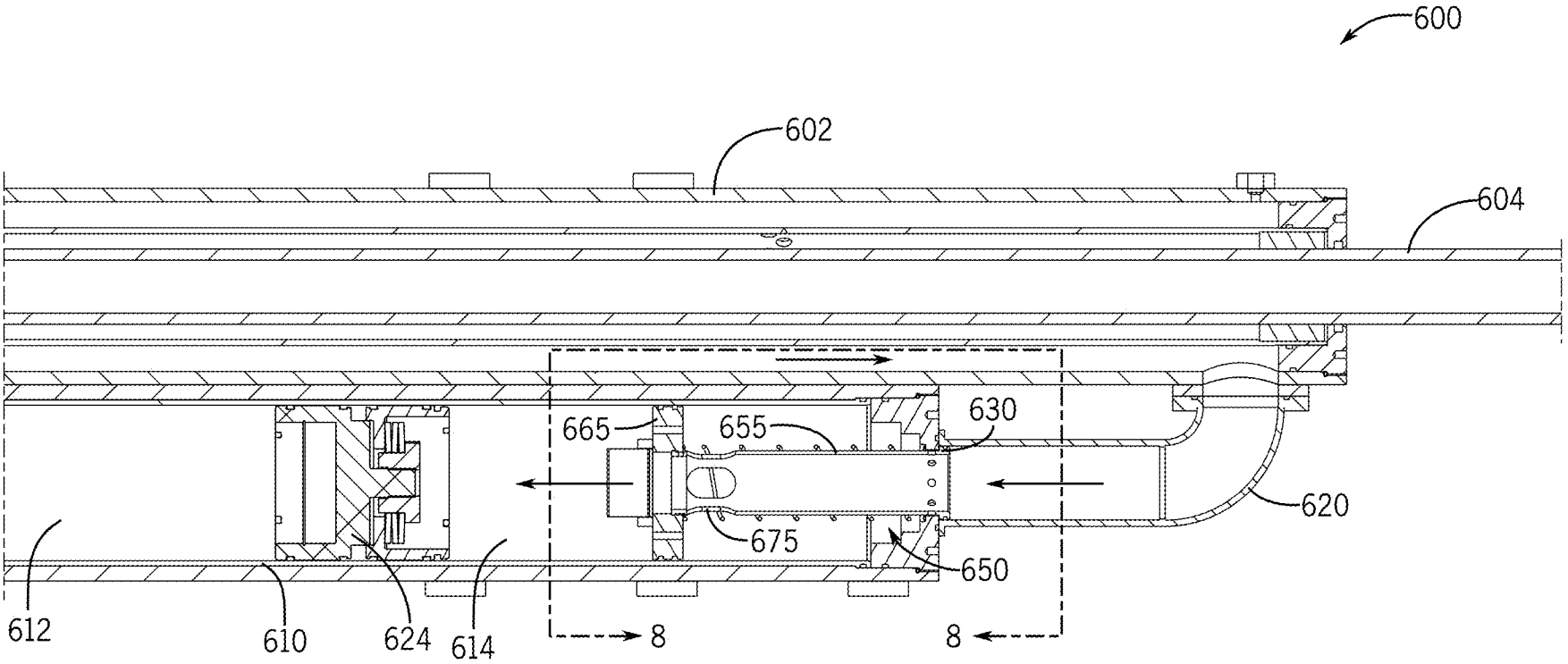
FIG. 7 depicts a cross-sectional view of a soft recoil system during a recoil phase.
Figure 8:
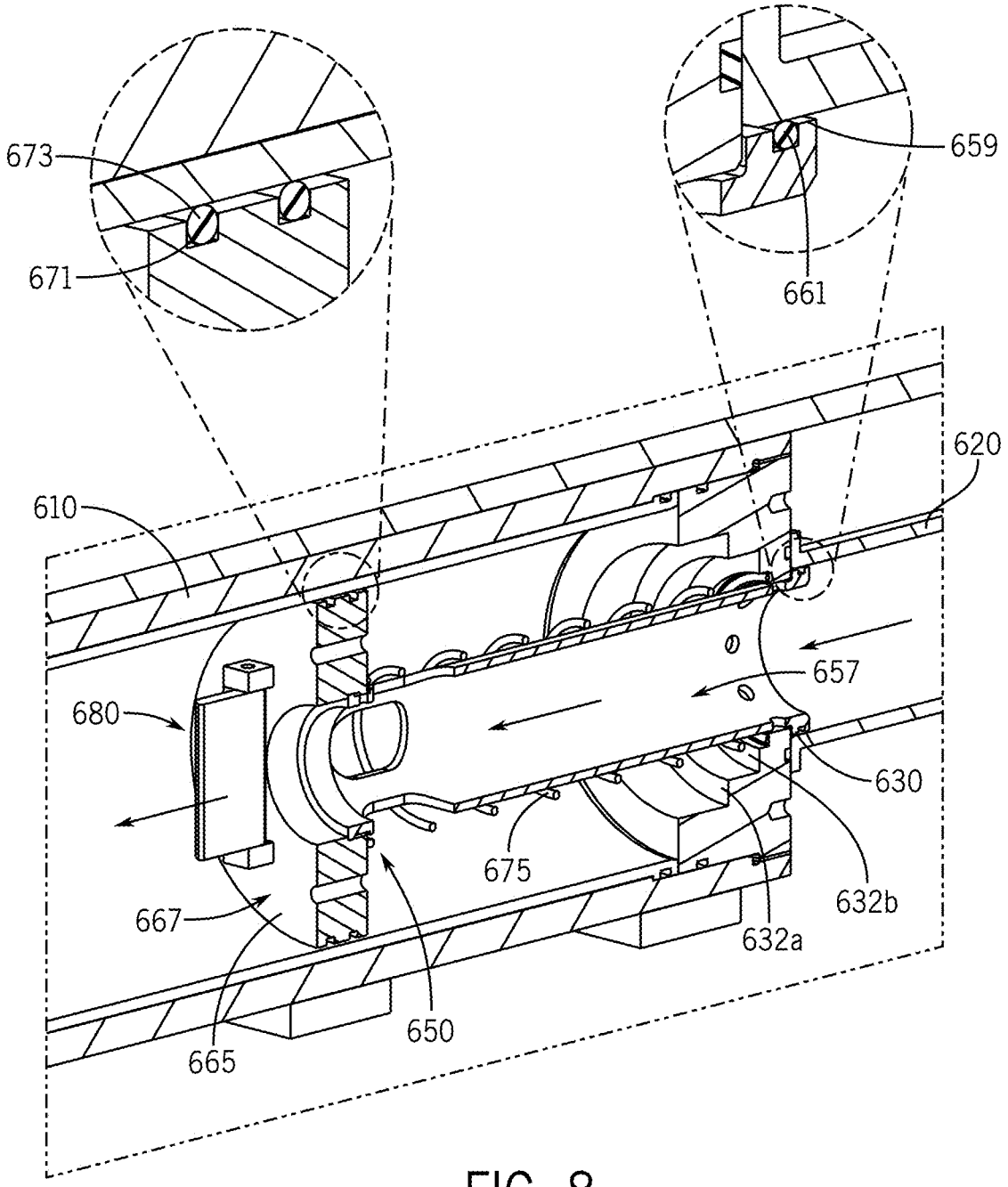
FIG. 8 depicts detail 8-8 of a temperature compensator of FIG. 7 during the recoil phase.
Figure 9:
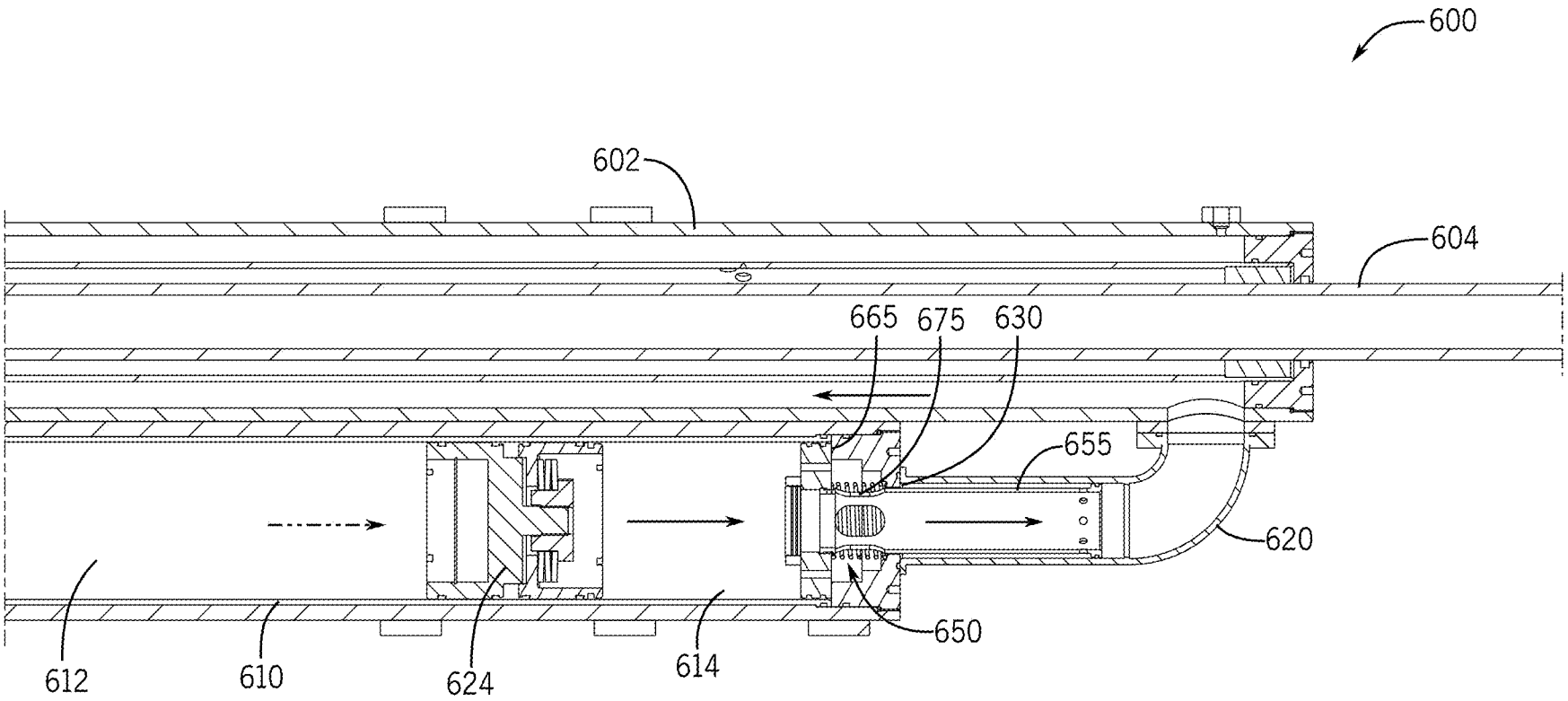
FIG. 9 depicts a cross-sectional view of a soft recoil system during a counter recoil phase.

FIGS. 6-9 provide cross-sectional views of the recoil system during various phases of operation. For example, FIG. 6 provides a cross-sectional view during a run up phase, FIG. 7 provides a cross-sectional view during a recoil phase, FIG. 8 provides a detail view during the recoil phase, and FIG. 9 provides a cross-sectional view during a counter recoil phase. More specifically, FIGS. 6-9 depict the operation of a temperature compensator 650, according to embodiments herein, during each of the foregoing phases. The temperature compensator 650 can be substantially analogous to any of the temperature compensators described herein. For example, the temperature compensator 650 can operate to limit the travel of a floating piston in order to mitigate the impact of temperature increases in the compressible fluid. The temperature compensator 650 can also operate to facilitate return of the floating piston to an initial or latch position, for example, by increase a rate of flow through the temperature compensator, via one or more flow control elements. The temperature compensator 650 can include similar components that perform similar functions as the temperature compensator 500, 70 or any temperature compensators described and include: a tube 655; a flange 665; a one-way valve 680; and a biasing element 675, redundant explanation of which is omitted here.

The temperature compensator 650 is shown in FIGS. 6-9 in the context of a recoil system 600. The recoil system 600 can be substantially analogous to any of the recoil systems described herein, including the recoil system 10, and as such include similar components and/or perform similar functions. In this regard, the recoil system 600 can include: a recoil cylinder 602; a recoil rod 604; a recoil piston 606; a recuperator cylinder 610; a first recuperator chamber 612; a second recuperator chamber 614; a transfer manifold 620; a floating piston 624; and an outlet 630, redundant explanation of which is omitted here.

With reference to FIG. 6, the temperature compensator 650 is shown when the recoil system is in a run up phase. As described herein, pressure can be increased in the first recuperator chamber 612 and floating piston caused to move in a direction fluidly toward the recoil cylinder 602. The first recuperator chamber 612 is a pressurizable zone adapted to expand in size as the floating piston 624 moves toward the recoil cylinder 602. FIG. 6 illustrates the foregoing relationship with a representative first position 613*a* (shown in phantom line) of the floating piston 624 and a representative second position 613*b* (shown in phantom line) of the floating piston 624. The representative first position 613*a* can be illustrative of an initial or latch position of the floating piston 624, such as a position before the weapon is fired. The representative second position 613*b* can be illustrative of a position of the floating piston 624 during run up, or more generally a position of the floating piston 624 while the floating piston 624 is displacing fluid from the recuperator cylinder 610.

During the run up phase shown in FIG. 6, the temperature compensator 650 moves fluidly toward the recoil cylinder 602. For example, the floating piston 624 can displace the compressible fluid in the recuperator cylinder 610, which in turn causes the temperature compensator 650 to move. As described herein, the tube 655 of the temperature compensator 650 is disposed at least partially outside of the recuperator cylinder 610. For example, the tube 655 can extend through the outlet 630 and at least partially into the transfer manifold 620. As the temperature compensator 650 moves fluidly toward the recoil cylinder 602, the tube 655 slides relative to the outlet 630 and further into the transfer manifold 620. Fluid situated substantially between the flange 665 and the outlet 630 can be displaced into the recoil cylinder 602 in part by the sliding of the flange 665. The tube 655 includes various slots that extend into an elongated throughout portion defined by the tube 655. As such, fluid arranged with the recuperator cylinder 610 substantially adjacent the flange 665 can be moved into the transfer manifold 620 via the tube 655. As shown by the fluid directional arrows of FIG. 6, the fluid can move from the transfer manifold 620 and into the recoil cylinder 602. With sufficient pressure build up in the recoil cylinder 602, the recoil rod 604 can be driven forward. For example, pressure can increase about the recoil piston 606 in a manner that causes the recoil rod 604 to induce a desired momentum to counteract the firing of a round.

The temperature compensator 650 can continue moving fluidly toward the recoil cylinder until it reaches a "bottom out" position or stop position. At the bottom out position, as shown in FIG. 6, the temperature compensator 650 is substantially prevented from further movement away from the floating piston 624. For example, the flange 665 or stop can be arranged substantially within the recuperator cylinder 610 and have a cross-dimension that is greater than a cross-dimension of the outlet 630. Upon reaching the bottom out position, the driving force from the displacement of compressible fluid is reduced and subsequently ceases. This reduction in driving force mitigates additional travel of the floating piston 624. For example, the floating piston 624 can stop moving fluidly toward the recoil cylinder 602 when the driving force is reduced in this manner. Accordingly, even in instances where the compressible fluid is heated due to environmental or operational conditions and increases in volume, the excess volume of the heated fluid will be impeded from entering the recoil cylinder 602, due to the operation of the temperature compensator 650 and the recoil rod 604 may not be imparted with extra force that could otherwise cause the recoil system to generate an inappropriately large momentum.

FIG. 6 also shows the biasing element 675 in a compressed configuration. As described above, the biasing element 675 is compressible between the flange 665 and the portion of the interior of the recuperator cylinder 610 surrounding the outlet 630. The biasing element stores energy therein that can be used during subsequent phases of operation, such as a recoil and/or counter-recoil phases to facilitate return of the recoil system components to their initial or latch positions.

With reference to FIG. 7, the temperature compensator 650 is shown when the recoil system 600 is in the recoil phase. As described herein, as the recoil rod 604 returns into the recoil cylinder 602, the compressible fluid in the recoil cylinder 602 can return to the recuperator cylinder 610. The compressible fluid can travel through the transfer manifold 620 and along the flow path indicated in FIG. 7, and into the recuperator cylinder 610 via the outlet 630.

The flow of compressible fluid into the recuperator cylinder 610 can cause the temperature compensator 650 and floating piston 624 to move fluidly away from the recoil cylinder 602. The compressible fluid can move into the recuperator cylinder 610 with sufficient driving force in order to move the flange 665 away from the outlet 630. The compressible fluid can also flow through the tube 655 and cause the one-way valve 680 to open. For example, the one-way valve 680 can include articulable doors (e.g., articulable doors 542*a*, 542*b* of FIG. 5A) that articulate into an open arrangement in response to the compressible fluid moving through the tube 655 and fluidly away from the recoil cylinder 602. In other cases, other flow control elements can be used, as described and contemplated herein.

The one-way valve 680 can therefore be used to define a flow path through the temperature compensator 650 for the compressible fluid. The one-way valve 680 permits increased fluid flow through the temperature compensator 650 when in an open configuration, mitigating impediments to compressible fluid reentry into the recuperator cylinder 610. The compressible fluid can travel along this flow path, through the temperature compensator 650, and cause the floating piston 624 to move toward an initial or latch position. This is illustrated in FIG. 7, with the floating piston 624 being arranged within the recuperator cylinder 610 at a position that is further away from the outlet 630 than as compared with the position of the floating piston 624 during the run up phase depicted in FIG. 6.

With reference to FIG. 8, detail 8-8 of the temperature compensator 650 is shown, as depicted in the recoil phase of FIG. 7. FIG. 8 shows the compressible fluid progressing from the transfer manifold 620 and into an elongated through portion 657 defined by the tube 655. The compressible fluid can continue through the elongate through portion 657 and exit the temperature compensator 650 via the one-way valve 680. As the fluid progresses through the temperature compensator 650, the fluid can operate to move the temperature compensator 650 fluidly away from the transfer manifold 620. As the temperature compensator 650 is free to move fluidly away from the transfer manifold 620, the biasing element 675 can release the energy stored therein and encourage the temperature compensator 650 to move toward the floating piston 624. In this regard, the biasing element 675 is shown in FIG. 8 in a substantially uncompressed state, as compared with the compressed state of the biasing element 675 shown in FIG. 7.

FIG. 8 also depicts components of the temperature compensator 650 that can facilitate engagement of the temperature compensator 650 and the recuperator cylinder 610, transfer manifold 620, and more generally other components of the recoil system 600. In certain embodiments, the temperature compensator 650 can be slidably engaged with an interior of the recuperator cylinder 610. FIG. 8 shows the flange 665 as being associated with a circumferential sealing element 673. The circumferential sealing element 673 can be an O-ring or other component that facilitates movement, such as slideable movement, between the flange 665 and the recuperator cylinder 610. The flange 665 can also include a retaining feature 671, such as those described therein, to restrain the circumferential sealing element 673 during movement of the temperature compensator 650. The circumferential sealing element 673 can also mitigate fluid leakage between the flange 665 and an interior wall of the recuperator cylinder 610.

The temperature compensator 650 can also be slideable engaged with the outlet 630 of the recuperator cylinder 610 and/or surface or associated features of the transfer manifold 620. For example, the tube 655 can extend through the outlet 630 and at least partially into the transfer manifold 620, sliding therein as the temperature compensator 650 moves during the various phases of operation of the recoil system. FIG. 8 shows the tube 655 as being associated with a circumferential sealing element 661. The circumferential sealing element 661 can be an O-ring or other component that facilitates movement, such as slideable movement, between the tube 655 and the transfer manifold 620. Additionally or alternatively, the element 661 can also facilitate sliding movement with or relative to the outlet 630. The tube 655 can also include a retaining feature 659, such as those described therein, to restrain the circumferential sealing element 661 during movement of the temperature compensator 650. The circumferential sealing element 661 can also mitigate fluid leakage between the tube 655 and an interior wall of the transfer manifold 620 or the outlet 630, as may be appropriate for a given application.

The outlet 630 depicted in FIG. 8 is arranged adjacent the transfer manifold 620. As described herein, the outlet 630 can be a reduced width portion of the recuperator cylinder 610. The outlet 630 therefore defines a flow path for fluid entry and exit from the recuperator cylinder 610 and the transfer manifold 620. And with the outlet 630 being a reduced width portion of the recuperator cylinder 610, the temperature compensator 650 can be inhibited from exiting the recuperator cylinder. For example, as shown in FIG. 8, the flange 665 has a larger cross-dimension than that of the outlet 630, and as such, the interior surface of the recuperator cylinder surrounding the outlet 630 limits the total travel of the temperature compensator 650.

In certain embodiments, such as that shown in FIG. 8, the interior of the recuperator cylinder 610 surrounding the outlet 630 can include one or more features that transition the width of the recuperator cylinder 610 to that of the outlet 630. For example, the recuperator cylinder 610 can include recesses of graduations that gradually and/or abruptly change the width of the recuperator cylinder 610. This is illustrated in FIG. 8 with recessed portion 632*a*, 632*b*. The recessed portions 632*a*, 632*b* can be or otherwise define reduced width portions of the recuperator cylinder 610. Accordingly, the recessed portion 632*a*, 632*b* can provide one or more physical barriers that limits the travel of the temperature compensator 650 toward the transfer manifold 620.

With reference to FIG. 9, the temperature compensator 650 is shown when the recoil system in the counter recoil phase. During the counter recoil phase, at least some compressible fluid can be encouraged to flow from the recuperator cylinder 610 and into the transfer manifold 620. For example, once the floating piston 624 and the temperature compensator 650 have moved sufficiently away from the outlet 630, the "fluid spring" defined by the first chamber 612 (e.g., which can be filled with a compressible gas, such as nitrogen), can encourage the floating piston 624 to move back toward the outlet 630 in order to reach an initial or latch position. This can cause the temperature compensator 650 to move correspondingly towards the outlet 630 and move at least some of the compressible fluid from the second chamber 614 and into the transfer manifold 620.

In the counter recoil phase, the movement of the floating piston 624 back toward the outlet 630 can thus cause the one-way valve 680 to close. For example, where the one-way valve 680 is defined by articulable doors, the flow of compressible fluid can cause the doors articulated into a closed position, thus mitigating fluid flow through the elongated through portion of the temperature compensator 650. The floating piston 624 and temperature compensator 650 can generally continue to move together until the recoiling parts reach the latch position. Depending on the recoil distance behind the latch, the temperature compensator 650 may not necessarily bottom out during the counter recoil stroke. Once the recoiling parts are at latch, the biasing element 675 on the temperature compensator 650 can return the temperature compensator 650 to its original pre-fire position. For example, the biasing element 675 can be at least partially compressed during the counter recoil phase, as shown in FIG. 9, and the energy stored in the biasing element 675 can be subsequently released to encourage the temperature compensator 650 to return to its pre-fire position.

Figure 10:
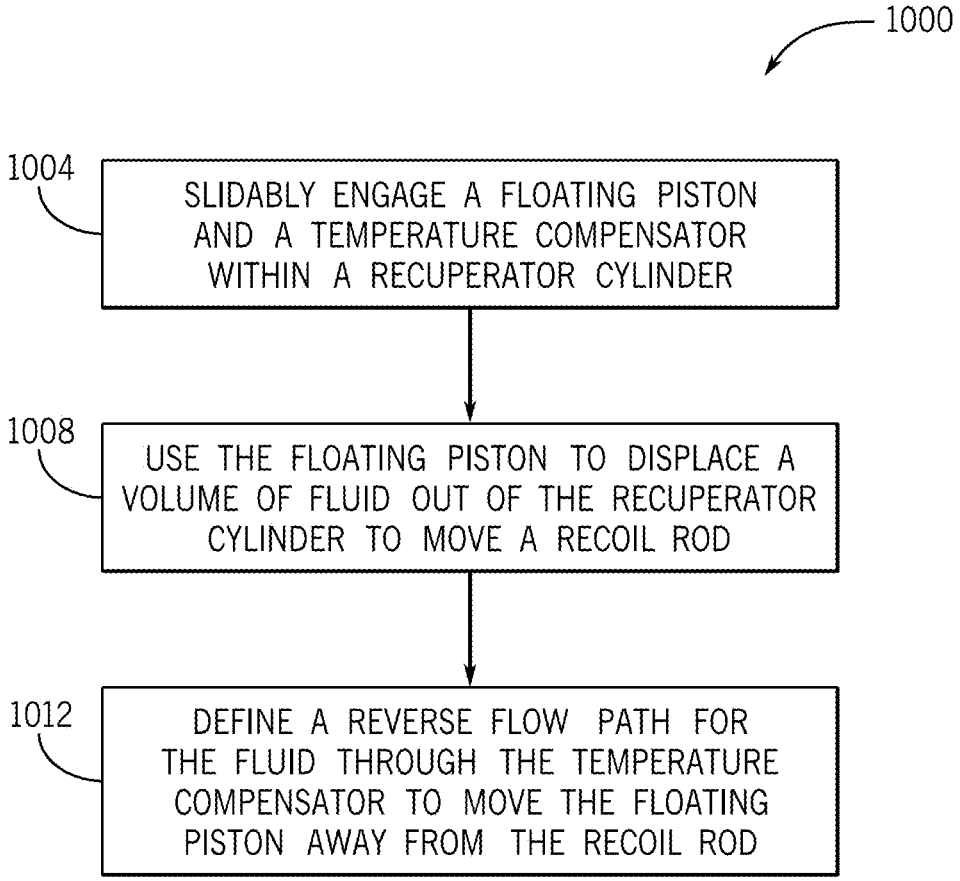
FIG. 10 depicts a flow diagram of a method for regulating compressible fluid flow in a soft recoil system.

To facilitate the reader's understanding of the various functionalities of the embodiments discussed herein, reference is now made to the flow diagram in FIG. 10, which illustrates process 1000. While specific steps (and orders of steps) of the methods presented herein have been illustrated and will be discussed, other methods (including more, fewer, or different steps than those illustrated) consistent with the teachings presented herein are also envisioned and encompassed with the present disclosure.

In this regard, with reference to FIG. 10, process 1000 relates generally to a method for regulating compressible fluid flow in a recoil system. The process 1000 can be used with any of the recoil systems and temperature compensators described herein, for example, such as the recoil systems 10, 600 and/or temperature compensators 70, 500, 650 and variations and combinations thereof.

At operation 1004, a floating piston and a temperature compensator can be slideably engaged within a recuperator cylinder. The recuperator cylinder can be fluidly couplable with a recoil rod that is separated from the floating piston by the temperature compensator. For example and with reference to FIG. 6, the floating piston 624 can be slideably engaged with the recuperator cylinder 610. Further, the temperature compensator 650 can be slideably engaged with the recuperator cylinder 610. In some cases, circumferential sealing elements 673, 661 can be used to define a slideable engagement between components of the temperature compensator 650 and the recuperator cylinder 610. The recuperator cylinder 610 can be fluidly couplable with the recoil rod 604 via the transfer manifold 620. The floating piston 624 can be separated from the recoil rod 604 by the temperature compensator 650.

At operation 1008, the floating piston can be used to displace a volume of fluid out of the recuperator cylinder to move the recoil rod. The volume of fluid can be limited by a travel of the temperature compensator at least partially out of the recuperator cylinder. For example and with reference to FIG. 6, the floating piston 624 can move from a first position 613*a* within the recuperator cylinder 610 to a second position 613*b* within the recuperator cylinder 610. As the floating piston 624 moves from the first position 613*a* to the second position 613*b*, the floating piston operates to displace compressible fluid held generally within the second chamber 614 into the transfer manifold 620. As described above, the temperature compensator 650 is arranged between the floating piston 624 and the transfer manifold 620. The temperature compensator 650 can define a physical barrier that limits the travel of the floating piston toward the transfer manifold 620. With the volume of fluid displaceable by the floating piston 624 at least partially dependent on the total available travel distance of the floating piston 624 within the recuperator cylinder 610, the temperature compensator 650 can therefore limit the maximum volume of compressible fluid that the floating piston 624 can displace from the recuperator cylinder 610.

At operation 1012, a reverse flow path can be defined for the fluid through the temperature compensator to move the floating piston away from the recoil rod. For example and with reference to FIGS. 7 and 8, the one-way valve 680 can open during the recoil phase of a firing sequence. During the recoil phase, the compressible fluid can travel from the recoil cylinder 602 and into the recuperator cylinder 610 via the temperature compensator 650. For example, the compressible fluid can flow through the tube 655 and cause the articulable doors of the one-way valve to open. This can permit the compressible fluid to flow through the temperature compensator 650 and cause the floating piston 624 to move in a reverse direction within the recuperator cylinder, away from the outlet 630.

Other examples and implementations are within the scope and spirit of the disclosure and appended claims. For example, features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A soft recoil system for a gun, the system comprising:

a recuperator cylinder fluidly connected to a recoil cylinder, the recoil cylinder housing a slideable recoil rod that counteracts a force associated with firing a round;

a floating piston positioned within the recuperator cylinder; and a temperature compensator positioned at least partially within the recuperator cylinder and arranged along a fluid path defined between the floating piston and the recoil cylinder, the temperature compensator configured to alternate between:

a first configuration in which the temperature compensator limits a volume of fluid the floating piston drives toward the recoil cylinder; and a second configuration in which the temperature compensator permits fluid flow therethrough for driving the floating piston away from the recoil cylinder.

2. The soft recoil system of claim 1, wherein:

the recuperator cylinder has an outlet fluidly coupling the volume of fluid with the recoil cylinder; and the temperature compensator is engageable with the outlet to restrict fluid flow therethrough.

3. The soft recoil system of claim 2, wherein:

the temperature compensator is immersed with the volume of fluid; and the floating piston defines a boundary within the recuperator cylinder between the volume of fluid and a pressurizable zone, the pressurizable zone adapted to expand, thereby forcing the volume of fluid toward the outlet via the floating piston.

4. The soft recoil system of claim 2, wherein the temperature compensator comprises a flange slidably engaged with an interior of the recuperator cylindrical and moveable therein to a position adjacent to and covering the outlet.

5. The soft recoil system of claim 4, wherein the temperature compensator further comprises a tube extending from the flange and slideable through the outlet, the tube defining an elongated through portion permitting fluid flow through the temperature compensator.

6. The soft recoil system of claim 5, wherein:

the tube defines a free end opposite the flange positioned within a transfer manifold, the transfer manifold fluidly coupled with the recoil cylinder;

the elongated through portion is open at the free end; and the tube comprises a tube wall having a slot extending therethrough fluidly coupling an exterior of the tube wall with the transfer manifold via the elongated through portion.

7. The soft recoil system of claim 1, wherein the temperature compensator comprises a one-way valve configured to:

restrict fluid flow through the temperature compensator in response to the volume of fluid moving toward the recoil cylinder, and increase fluid flow through the temperature compensator in response to the volume of fluid moving away from the recoil cylinder.

8. The soft recoil system of claim 7, wherein:

the temperature compensator defines an elongated through portion along an axis of the recuperator cylinder; and the one-way valve is operable to overlap the elongated through portion in the first configuration, and in the second configuration, expose an entire cross-dimension of the through portion to the floating piston.

9. A temperature compensator for regulating compressible flow in a soft recoil system, the temperature compensator comprising:

a tube having opposing first and second ends, and an elongated through portion extending therebetween;

a flange extending radially from the first end of the tube and configured for sliding engagement within a recuperator cylinder of the soft recoil system;

a biasing element associated with the tube and compressible against the flange as the second end moves away from the recuperator cylinder; and a one-way valve coupled to the flange at the first end and configured to restrict fluid entry to the elongated through portion via the first end.

10. The temperature compensator of claim 9, wherein:

the flange defines a face adapted to extend across a diameter of the recuperator cylinder, and the elongated through portion extends through the face.

11. The temperature compensator of claim 10, wherein the one-way valve is arranged at the face and covering the through portion, in a first configuration.

12. The temperature compensator of claim 11, wherein the one-way valve comprises a pair of articulable doors moveable from a closed position covering the through portion in the first configuration, to an open position in which the one-way valve completely uncovers the through portion at the face.

13. The temperature compensator of claim 10, wherein the flange defines one or more ports about the through portion, providing fluid flow through the flange independent of a configuration of the one-way valve.

14. The temperature compensator of claim 9, wherein the tube defines slots adjacent the flange and extending into the through portion.

15. The temperature compensator of claim 14, wherein:

the second end is moveable through a transfer manifold that is fluidly coupled with a recoil cylinder, the recoil cylinder housing a slideable recoil rod that counteracts a force associated with firing a round; and the slots define a flow path fluid from within the recuperator cylinder adjacent the flange to within the transfer manifold.

16. The temperature compensator of claim 15, wherein:

the biasing element comprises a spring with the tube extending therethrough; and the spring is configured to bias the temperature compensator away from the transfer manifold.

17. A method for regulating compressible fluid flow in a soft recoil system, the method comprising:

slideably engaging a floating piston and a temperature compensator within a recuperator cylinder, the recuperator cylinder fluidicaly couplable with a recoil rod that is separated from the floating piston by the temperature compensator;

using the floating piston to displace a volume of fluid out of the recuperator cylinder to move the recoil rod, the volume being limited by a travel of the temperature compensator at least partially out of the recuperator cylinder; and defining a reverse flow path for the fluid through the temperature compensator to move the floating piston away from the recoil rod.

18. The method of claim 17, wherein:

the floating piston defines a boundary between the volume of fluid and a pressurizable zone within the recuperator cylinder; and the operation of using the floating piston comprises moving the floating piston toward the temperature compensator by expanding the pressurizable zone, thereby driving the volume of fluid out of the recuperator cylinder.

19. The method of claim 18, further comprising engaging an outlet of the recuperator cylinder with the temperature compensator, in response to the movement of the floating piston.

20. The method of claim 19, wherein the temperature compensator comprises a flange having a surface facing the floating piston and extending across a diameter of the recuperator cylinder, the surface restricting flow through the flange and configured to move the temperature compensator in response to the floating piston driving the volume of fluid out of the recuperator cylinder.

21. The method of claim 17, wherein the operation of defining the reverse flow path comprises opening a one-way valve configured to permit flow of the volume of fluid along the reverse flow path through the temperature compensator.

22. The method of claim 17, wherein the operation of slideably engaging comprises mounting the floating piston and the temperature compensator at a position within the recuperator cylinder using circumferential sealing elements.

* * * * *